US005828300A

United States Patent [19]

Addy et al.

[11] Patent Number: 5,828,300

[45] Date of Patent: Oct. 27, 1998

[54] ALARM SYSTEM WITH SUPERVISION CONTROLLED RECEIVER PARAMETER MODIFICATION

[75] Inventors: Kenneth Addy, Massapequa; Francis C. Marino, Dix Hills; Thomas P. Schmit, Huntington, all of N.Y.

[73] Assignee: Pittway Corporation, Chicago, Ill.

[21] Appl. No.: 650,292

[22] Filed: May 20, 1996

[51] Int. Cl.[6] ..... G08B 1/08

[52] U.S. Cl. ..... 340/539; 340/506; 340/514

[58] Field of Search ..... 340/539, 506, 340/514, 825.06; 364/138, 140, 141

[56] References Cited

U.S. PATENT DOCUMENTS

| | | | |
|---|---|---|---|
| 4,101,872 | 7/1978 | Pappas | 340/539 |
| 4,191,948 | 3/1980 | Stockdale | 340/539 |
| 4,367,458 | 1/1983 | Hackett | 340/539 |
| 4,442,426 | 4/1984 | Heuschmann et al. | 340/539 |
| 4,523,184 | 6/1985 | Abel | 340/539 |
| 4,672,365 | 6/1987 | Gehman et al. | 340/539 |
| 4,754,261 | 6/1988 | Marino | 340/539 |

*Primary Examiner*—Donnie L. Crosland
*Attorney, Agent, or Firm*—Anthony R. Barkume, P.C.

[57] ABSTRACT

A self-testing data communications system suitable for use with an alarm system, the communications system being capable of modifying an operational parameter such as the input signal sensitivity of a receiver located at a monitoring station during receipt of a supervision signal from a remote alarm device, in order to ensure that a non-supervision alarm signal will be properly received when the operational parameter is again returned to its normal state.

48 Claims, 5 Drawing Sheets

ALARM SYSTEM WITH SUPERVISION CONTROLLED RECEIVER PARAMETER MODIFICATION

BACKGROUND OF THE INVENTION

The present invention relates to communications devices and protocols such as those used in alarm systems having multiple sensors in communications with one or more receiver/control units; and in particular to such alarm systems wherein an operational parameter of the receiver, such as its input signal sensitivity, is modified during the reception of a supervision signal from an associated transmitting sensor device in order to ensure there is adequate margin between the transmitter and the receiver during normal alarm signal transmission operations.

Most radio frequency (RF) wireless security systems available today, such as those manufactured by ADEMCO, generally employ a multiplicity of transmitter products which transmit information to a common receiver/control. The information transmitted typically describes the state of various transducers associated with each transmitter, such as smoke, motion, breaking glass, shock and vibration detectors; door, window and floor mat switches; etc. These transmitter products are designed to be low in cost and are typically send-only devices, as opposed to send/receive, or transceiver, devices which are significantly more expensive. In order to meet basic regulatory agency requirements, the transmitters are required to transmit periodic supervision transmission signals in order for the control to monitor proper operation of all of the transmitters in a given system. The supervision signal (as well as an alarm signal) has a unique identification code embedded in its data message, which serves to identify to the system control which particular transmitting device has sent that supervision (or alarm) message. Typically, when a supervision signal is properly received and detected by the receiver unit, the transmitter identification code is supplied to the system control for further processing.

For life safety applications, the RF wireless system must also comply with more stringent regulations, such as the Underwriters Laboratories regulation UL864. This regulation additionally requires that the supervision signal be reduced in transmission power level below that of the alarm (normal, non-supervision) signal transmission by a minimum of 3 dB or by other equivalent means, to ensure that the alarm signal has an effective power margin over that of the periodic supervision signals from each transmitter in the system.

To employ transmitter-only products that would accurately transmit an alarm signal at the maximum allowable level and to reduce that power level by a minimum of 3 dB during the periodic supervision signal transmission would add significant additional cost to each transmitter product. Furthermore, most transmitter circuits were designed prior to the advent of the regulations such as the UL864 requirement, making it necessary to redesign and replace all of the transmitter circuits presently on the market despite the fact that they already meet all of the other applicable UL, FCC, and other regulatory requirements.

It would therefore be advantageous to employ an alarm system which effectively reduces the transmission power level of the supervision signal below that of the normal alarm signal by a minimum of 3 dB and therefore ensures that the alarm signal has an effective minimum 3 dB margin over that of the periodic supervision signals from each transmitter in the system, without modification to existing transmitter devices already in commercial use.

It is therefore an object of the present invention to provide a communications system suitable for use with an alarm system which provides for effectively reducing the supervision signal strength without actual modification of the supervision signal generated by the transmitting device.

It is a further object of the present invention to provide a method of modifying an operational parameter of the receiver, such as changing the receiver sensitivity, during a supervision transmission sequence to accomplish these objectives.

It is a still further object of the present invention to provide for the logical prevention of the transmitter identification code from being sent to the system control during a multi-message supervision transmission sequence from that transmitter after one of those messages has been properly received at the normal sensitivity level and if none of the subsequent supervision messages from that same transmitter during that same transmission sequence have been properly received at the reduced sensitivity level.

It is a still further object of the present invention to provide for the logical allowance of the transmitter identification code to be sent to the system control during a multi-message supervision transmission sequence from that transmitter after one of those messages has been properly received at the normal sensitivity level and if any one of the subsequent supervision messages from that same transmitter during that same transmission sequence has been properly received at the reduced sensitivity level.

It is yet a further object of the present invention to provide for the application of an effective maximum time limit that the receiver sensitivity can be maintained in the reduced state in order to ensure that all subsequent normal alarm transmissions are received and processed at full receiver sensitivity.

It is a still further object of the present invention to provide for the automatic allowance of one or more transmitter identification codes to be sent to the system control, whether they are supervision or alarm transmissions, if they are properly received within the maximum time delay in which the receiver sensitivity is maintained in its reduced state.

It is a still further object of the present invention to provide an effective method of differentiating between supervision and normal alarm transmissions.

SUMMARY OF THE INVENTION

In accordance with these and other objects, the present invention is a data communications method and system comprising a plurality of remote devices comprising means for transmitting supervision signals and non-supervision signals, and a receiving station comprising means for receiving the supervision signals and the non-supervision signals, the receiving means having at least one operational parameter capable of being modified, and processing means for modifying the operational parameter of the receiving means in response to the receipt of a supervision signal. Each of the supervision signals comprise at least first and second messages correlated to each other, and the processing means modifies the operational parameter of the receiving means in response to the receipt of a first message from a supervision signal. If a subsequent message correlated to the first message is received while the operational parameter of the receiving means is modified, the processing means allows the supervision signal to be further processed by the receiving station as a successfully received supervision signal and returns to normal the modified operational parameter of the receiving means. The processing means also returns to normal the modified operational parameter of the receiving means after a predetermined time has elapsed if a subsequent message correlated with the first message is not received while the operational parameter of the receiving means is modified, and the supervision signal is not further processed by the receiving station as a successfully received supervision signal. When, however, a subsequent message not correlated with the first message is received while the operational parameter of the receiving means is modified, the subsequent message is further processed by the receiving station as a successfully received message and the modified operational parameter is maintained by the receiver.

In one preferred embodiment, the operational parameter capable of being modified is the input signal sensitivity of the receiver means, and the input signal sensitivity is so modified by being reduced. In this case, the input signal sensitivity of the receiver is returned to normal by being increased to normal operating level. Further, the subsequent message is determined to be correlated to the first message when they are identical to each other. The remote devices and the receiving means communicate by radio frequency electromagnetic wave transmission, and at least one of the remote devices is associated with an alarm sensor.

Thus, the present invention is based on the premise that instead of reducing the maximum allowable power of the periodic supervision signal transmissions, an equivalent means is to reduce the receiver sensitivity by an amount equivalent to reducing the transmitting power by 3 dB, but only during receipt of supervision signals, and to provide full receiver sensitivity when receiving non-supervision alarm signals. This invention provides a unique method of accomplishing the stated objectives effectively without compromising the security of the system.

The first requirement of the receiver is that it have the ability of changing the receive sensitivity by at least 3 dB to meet the applicable regulatory agency requirements. The receiver implemented in the present invention is a superheterodyne-type receiver and the circuit used to alter its sensitivity is common knowledge to those skilled in the art of narrow-band, short-range, RF superheterodyne receivers, and need not be discussed in any detail here. It is sufficient to say that the receiver sensitivity is altered between two pre-determined values by the logic 1 or logic 0 state of a microprocessor output connecting to that portion of the receiver circuits which determine the receiver sensitivity. This allows the receiver sensitivity to be under control of the microprocessor software.

Software control of the receiver sensitivity applied during a so-called test mode is disclosed in U.S. Pat. No. 4,754,261. During this test mode, the receiver sensitivity is significantly reduced. This provides additional margin for all of the transmitters in the system since during normal modes of operation full sensitivity is restored to the receiver. The present invention provided herein is a method of differentiating supervision signals from non-supervision alarm signals, reducing the receiver sensitivity a required amount during reception of the supervision signal, and applying full receiver sensitivity during reception of non-supervision alarm signals. This is done per each transmitter in the system during normal modes of operation.

DETAILED DESCRIPTION OF THE PREFERRED EMBODIMENT

Figure 1:
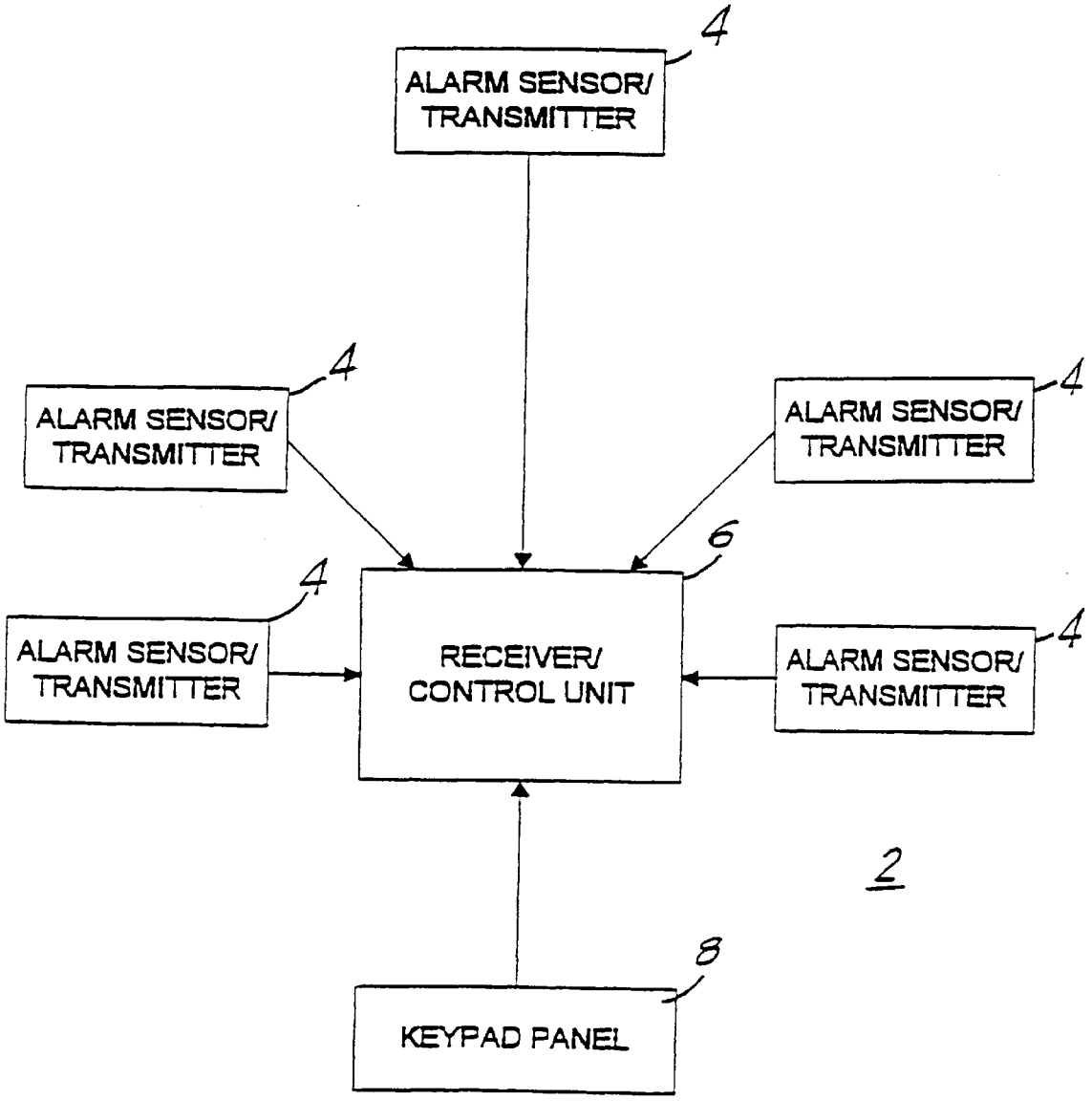
FIG. 1 is a block diagram of the preferred embodiment of the present invention.

Referring to FIG. 1, an alarm system 2 is shown, which includes a receiver/control unit 6 in communications with a plurality of remote devices 4, each of which comprise an alarm sensor and a data transmitting unit. The alarm sensors are well known in the prior art and include, for example, motion detectors, fire or smoke sensors, glass breakage sensors, door or window entry sensors, and the like. In the preferred embodiment, the alarm system 2 operates in a so-called "wireless" fashion by electromagnetic wave transmission (radio frequency in particular) between the remote devices 4 and the receiver/control unit 6. The transmitter units housed within each remote device 4 are also well known in the art, and transmit supervision and alarm message signals, to be described below, by modulating a high frequency RF signal (e.g. 345 MHz). The modulated RF signal is received, processed and decoded by the receiver/control unit 6 so that the control unit is provided with the data from the remote devices 4 and may act accordingly; e.g. by sounding an alarm speaker, dialing a police or fire station, etc. Further description of this type of wireless alarm system may be found in U.S. Pat. No. 4,754,261 to Marino, which is owned by the assignee of the present invention and is incorporated by reference herein.

The remote devices 4 are configured to transmit supervision signals and alarm signals in accordance with protocol known in the art. The supervision signals function to provide periodic "test" signals to the receiver/control unit 6 for the purpose of ensuring that each remote device 4 configured with the system 2 is in proper communication with the receiver/control unit 6. Since it is possible in this type of system that a remote device 4 may only transmit an alarm signal at a time of an emergency (i.e. when a window associated with the sensor is broken), it is imperative that the system 2 maintain a periodic method of ensuring that a device 4 is in proper communication with the receiver/control unit 6 so potential problems may be attended to promptly.

Figure 2:
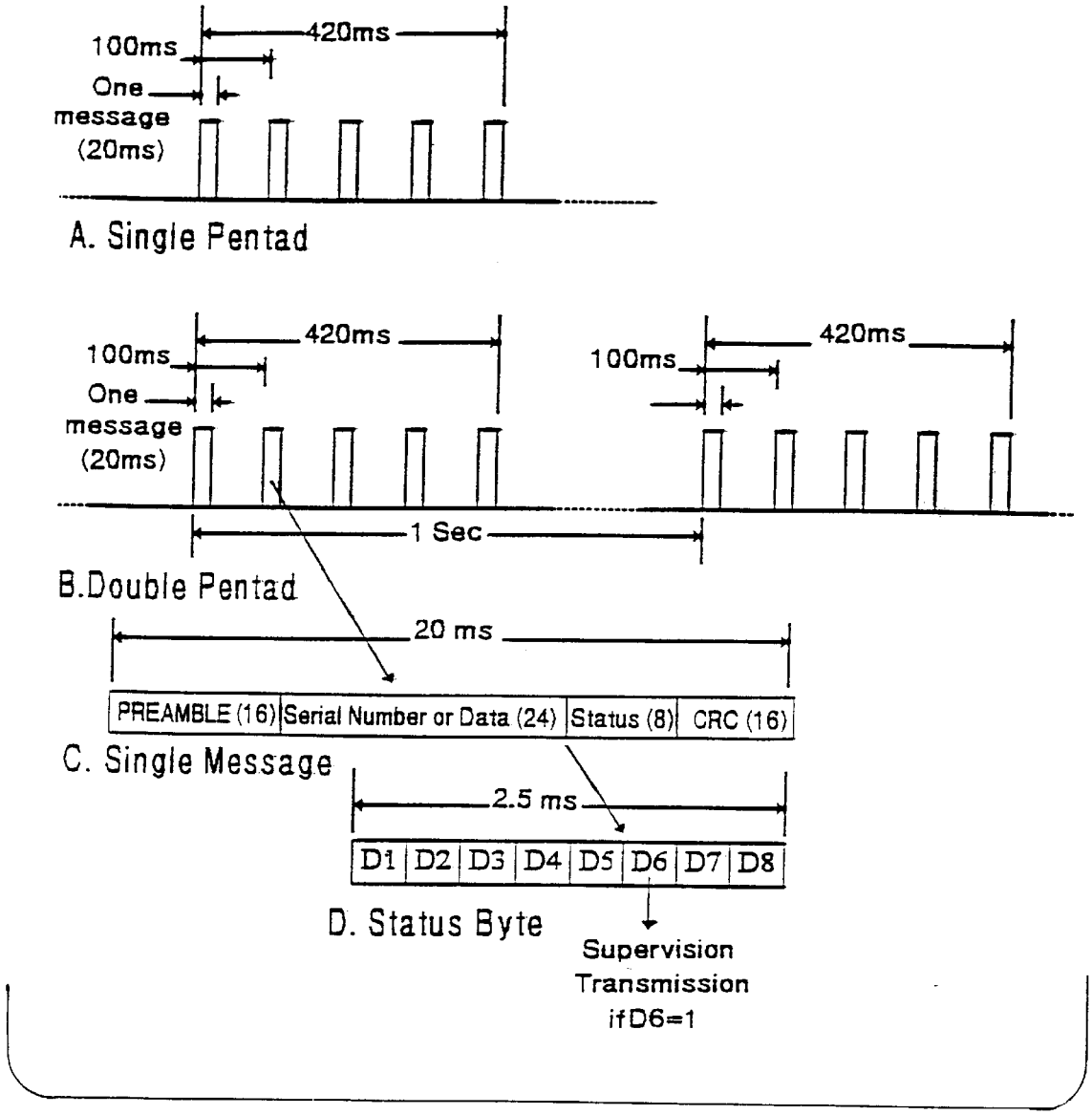
FIG. 2 is a timing diagram of the supervision and alarm messages processed by the preferred embodiment of the present invention.

Thus, a supervision signal is periodically sent from each remote device 4 in the system to the receiver/control unit 6 for monitoring purposes. In the preferred embodiment, a supervision transmission sequence consists of a single pentad, which is a single group of five identical messages, as shown in section A of FIG. 2. Each message is approximately 20 ms in duration and is repeated every 100 ms as shown in FIG. 2. A normal, non-supervision alarm signal, which is transmitted typically only when a change in status of the alarm sensor occurs (e.g. when a door is opened), consists of a double pentad, which is two groups of five identical messages separated in time by approximately 1 second. This is shown in section B of FIG. 2.

Each identical message is 64 bits long and has a 16-bit preamble, 24 bits of transmitter serial number or keypad data, a single 8-bit status byte, and a 16-bit CRC (Cyclical Redundancy Character), as shown in section C of FIG. 2. The status byte contains 8 data bits, shown as D1–D8 in section D of FIG. 2, which convey specific information. In this embodiment, D8=1 signifies that the received message was from a transmitter which is capable of generating supervision transmissions, whereupon D1–D4 represent the state of up to 4 sensor inputs to that transmitter, D5 indicates the state of that transmitter's battery, and D6=1 indicates that the received message was part of a supervision single pentad transmission. In this manner, the receiver circuitry is provided with coded information from the transmitter unit which enables it to determine if the message is part of a supervision signal or part of a normal, non-supervision alarm signal.

Figure 3:
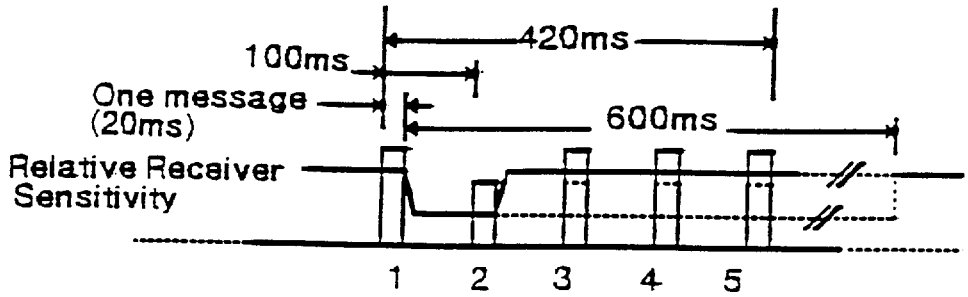
FIG. 3 is a timing diagram of the reduced receiver sensitivity executed by the preferred embodiment of the present invention.

When the receiver detects that the present message is part of a supervision pentad, the sensitivity of the receiver is immediately reduced. FIG. 3 illustrates how the receiver sensitivity is changed during reception of a supervision pentad. Starting with full receiver sensitivity, the first message of the pentad is properly received and analyzed. If this message is determined to be that of a supervision transmission (that is, D6=1) then the message is temporarily stored in a receiver buffer memory and the receiver sensitivity is immediately lowered to at least 3 dB below the full level. The lowered sensitivity level will remain in effect until a subsequent supervision message is properly received at this lowered level which matches the first message received at the full sensitivity level, or following a pre-determined time delay of 600 ms, whichever occurs first. If during this interval of reduced sensitivity, a supervision transmission is successfully received which does not match that which initiated the interval (i.e. the message stored in the receiver), then the supervision message for the non-matching transmitter ID is immediately sent to the control unit for subsequent processing.

It is possible for a signal (alarm or supervision) to be received from a different remote device 4 during the time that the receiver is in reduced sensitivity as a result of detecting the reception of a supervision signal. That is, a second received signal may be interleaved with a first received signal. In order for the receiver to properly process the interleaved second signal, the timeout period used for waiting for the next supervision message must be greater than the time for one pentad but less than the time before the second pentad of an alarm transmission can start. This will ensure receipt of (the second) transmission at the full sensitivity level even if it occurred slightly later than an interleaved first supervision transmission since a double pentad is always associated with alarm transmissions but only single pentads are used in supervision transmissions. From FIG. 2 it can be seen that this time delay must be greater than 400 ms (in order to allow at worst case the last of the remaining four messages to be detected), but less than 1 second (in order to bring the receiver back up to full sensitivity prior to the next pentad, if the transmission is a double pentad). Thus, a delay of 600 ms is used in this embodiment.

A typical scenario is illustrated in FIG. 3 in which the first supervision message results in a reduction of the receiver sensitivity level and the second supervision message, matching the first message, is properly received. In this case proper reception of the supervision message at the reduced sensitivity level has been established for that particular transmitter allowing the receiver to send the supervision message for that transmitter ID to the control. However, also evident in FIG. 3 is the continuation of the lowered sensitivity level if the second, third, etc. message fails to be properly received due to the lowered sensitivity. If all of the remaining four messages fail to be properly received at this reduced level, the required margin for that transmitter is assumed inadequate. In that case the supervision message for that transmitter ID will not be sent to the control. The control will thus be in receipt of only those supervision messages per transmitter ID in the system which can be received at the reduced sensitivity level, meeting the UL864 requirement.

Figure 4:
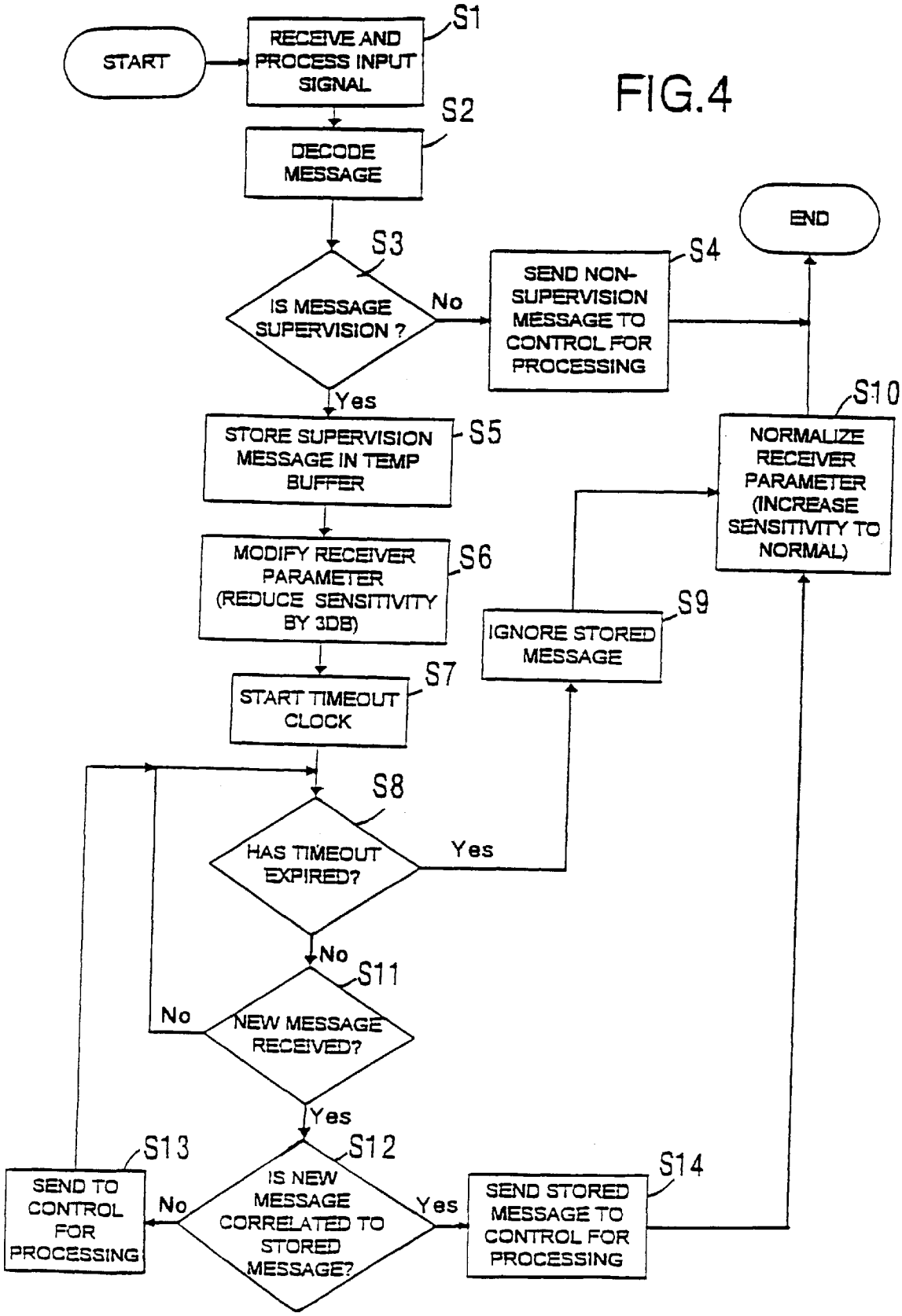
FIG. 4 is a flowchart of the operation of the preferred embodiment of the present invention.

This flow of operation of the present invention is illustrated by the flowchart set forth in FIG. 4. In step S1, the (RF) input signal is processed to provide a digital data signal. In step S2, the digital data signal is decoded to analyze the status bit D6 to determine if the message is supervision or non-supervision alarm. If step S3 determines the message to be non-supervision, then the message is sent to the control for processing at step S4 and the process is ended. If however, the message was determined to be a supervision message, then it is stored in a temporary buffer at step 5, and the receiver sensitivity is reduced by 3 dB at step S6. A timeout clock, which in the preferred embodiment is 600 ms as explained above, is then initiated at step S7. The process loops in a wait state via steps S8 and S11 until the timeout expires at step S8 or a new message is received at step S11.

If the timeout has expired without a new message being received while the receiver is in the reduced sensitivity state, then the stored message is ignored at step S9, the receiver sensitivity is increased back to normal at step S10, and the process is ended. In this case, since the supervision message was not properly received and detected while the receiver was in the reduced sensitivity state, then the transmitter ID associated with that supervision message is, in effect, thrown out, and the receiver control unit is never informed of its initial reception at the full sensitivity level. Thus, although the supervision signal was strong enough to be detected at the normal sensitivity level, it could not be received at the effective reduction of 3 dB in signal strength, and the UL864 test is not met for that remote device 4.

If however, a new message is received at step S11, then it is analyzed at step S12 to determine if it is the same as the message stored in the temporary buffer; that is, if it is from the same transmitter device or if has been received from a different transmitting device which has in effect interleaved its message stream with that of the originally received message. If the message is from a different transmitter, then it is sent to the control by step S13 (since it was successfully received at the reduced sensitivity level), and the wait state continues with steps S8 and S11. The timeout clock is not reset, since the receiver is still waiting for the next supervision message which matches that which initiated the reduction in sensitivity. Thus, if a new message matching the stored message is not received within the timeout period, the receiver sensitivity is increased to normal and the process ends with the stored message being ignored.

If, however, step S12 determines that the new message matches the stored message, then the test has passed and the message is sent to the control by step S14 for subsequent processing. The receiver sensitivity is increased back to normal and the process is exited.

Figure 5:
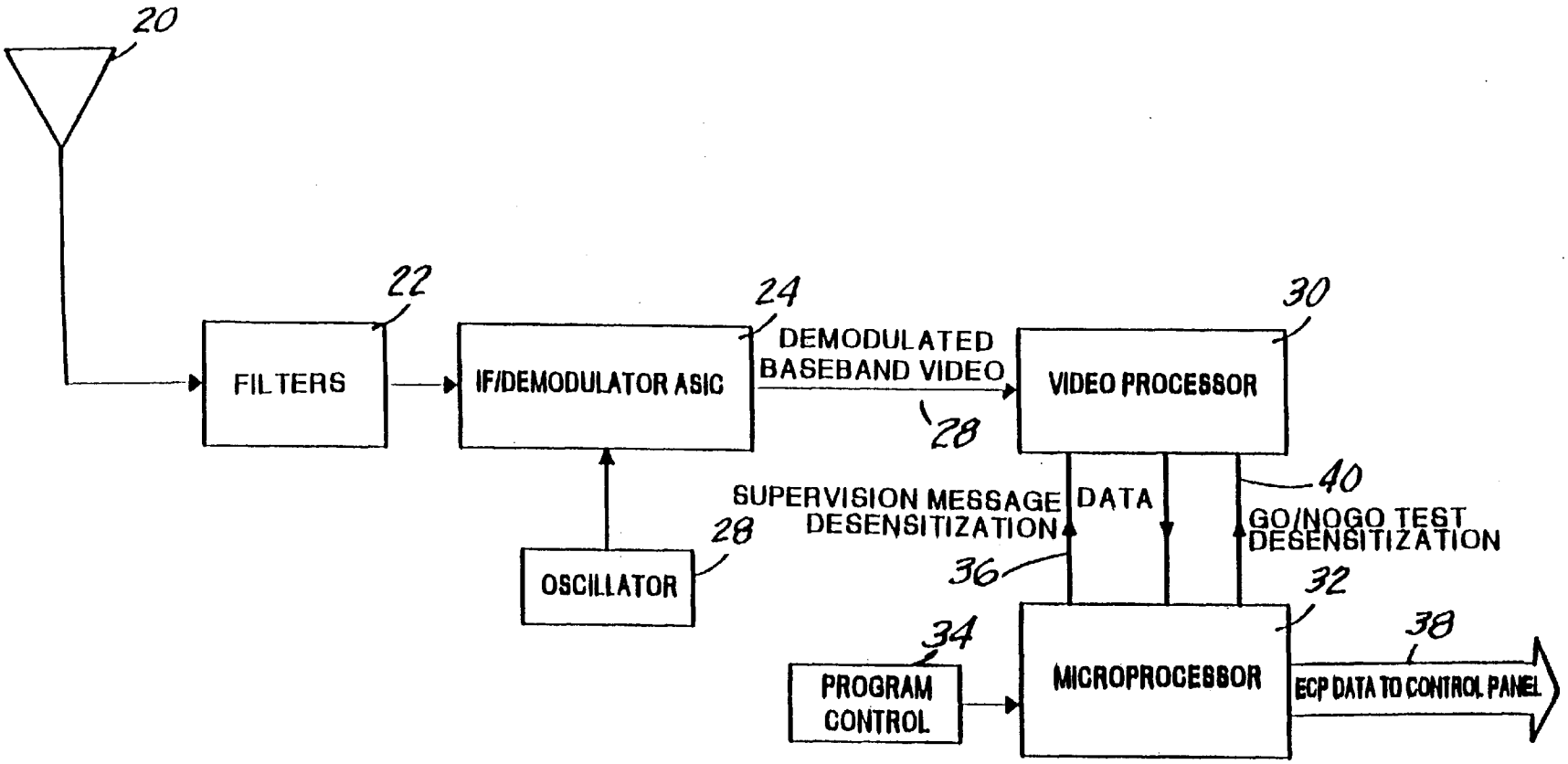
FIG. 5 is a block diagram of the receiver/control unit according to the preferred embodiment of the present invention.

FIG. 5 illustrates the circuit block diagram for the receiver/control unit 6 of the present invention. An RF signal is received at the antenna 20, and is filtered by section 22 and demodulated by section 24 in conjunction with a 355.7 MHz oscillator 26 in accordance with techniques well known in the art. A demodulated baseband video signal 28 is fed to a video processor circuit 30, which has programmable sensitivity for accomplishing the objectives of this invention. Reference is again made to U.S. Pat. No. 4,754,261 for further details. A microprocessor 32, along with appropriate ROM memory device 34 configured to store the program embodied by the flowchart of FIG. 4, is connected to the video processor 30 for supplying appropriate control signals thereto for controlling the receiver sensitivity. In particular, when a message is determined by the microprocessor to be a supervision message, the state of control signal 36 is changed to indicate to the video processor that the sensitivity of the receiver unit should be reduced by 3 dB. This control signal is again toggled in accordance with processing described above in order to return the receiver sensitivity to normal when required.

The transmitter identification data, along with other data pertinent for operation of the alarm system, is sent to the control unit (not shown here) for subsequent processing as described above via the ECP data bus 38, which is a four line interface comprising a ground and power line, and send and receive data lines in accordance with techniques well known in the art.

Control signal 40 allows for manual control of the receiver sensitivity, if desired, by means of the keypad panel 8 or the like, in order to place the system into a test mode for device installation purposes as described in the aforementioned U.S. Pat. No. 4,754,261.

The preferred embodiment has been described with reference to the reduction of the receiver sensitivity in order to provide an impaired transmission/reception function and thus test the margin of operation of the system to ensure it will perform according to applicable regulatory requirements. It is contemplated that the instant invention may be implemented by modifying other operational parameters of the receiver in order to obtain similar results. For example, as disclosed in the above-mentioned U.S. Pat. No. 4,754,261 to Marino, the clipping level of a shaping circuit used in conjunction with the receiver may be altered as a result of the detection of a supervision message, the baud rate of the receiver may be modified in order to put a higher demand on the system operation, etc. In addition, the receiver of the present invention could be configured to continually provide two output signals; one at full or normal input sensitivity, and one at reduced input signal sensitivity. In this case, the processor multiplexes or selects the appropriate receiver output in accordance with the teachings of the invention. Thus, during normal operation, the processor selects the receiver output produced at full sensitivity, and switches to the receiver output produced at the reduced sensitivity when a supervision message is decoded. The selected receiver output signal is then switched back to the receiver output produced at full sensitivity when the criteria previously described is met (e.g. subsequent matching supervision message or a timeout).

Further, although the preferred embodiment has been described in conjunction with a wireless RF system, the invention can be easily applied to traditional wired systems such as local area networks (LANs) and the like, wherein it may be necessary or desired to test the margin of operation between the transmitter and receiver functions.

Moreover, it is contemplated that while the preferred embodiment utilized supervision messages in a supervision signal which are identical to each other, it is possible to utilize supervision messages which correlate to each other in some predetermined fashion, rather than requiring them to be identical. Thus, supervision messages may be encoded with indicia representing the source of transmission, but may differ from each other in other ways. The system can be easily adapted to analyze the relationship between supervision messages to determine if they are properly correlated, thus determining that they were transmitted from the same source and allowing further processing of the message where appropriate.

It may also be desired to only perform the automatic self-test functions of the present invention as herein described on certain remote devices rather than on each one. That is, regulatory requirements may only mandate that life safety devices or applications be tested in this manner, while other devices in the system need not meet such rigorous communications standards. In such a system, the processing circuitry and software is provided with further intelligence in order to determine which supervision messages are to undergo receiver parameter modification. This may be accomplished by designating a flag bit in the message as a test/no-test bit, wherein a logic true indicates that the transmission margin be tested, and a logic false indicates that he test need not be done. Alternatively, the processor may implement a look-up table programmed with the identity of each device which is to undergo the transmission margin test, and thus utilize the device identification code to access the table and process the message accordingly.

Thus, while particular embodiments of the present invention have been shown and described, various modifications will be apparent to those skilled in the art, and therefore it is not intended that the invention be limited to the disclosed embodiment, or to details thereof, and departures may be made therefrom within the spirit and scope of the present invention. For example, although single groups of five identical messages are used in this embodiment for supervision transmissions and two groups of five identical messages for normal, alarm transmissions, other schemes could be equally used. For example, two or more identical, or different, messages per group for supervision transmissions, and an equal or greater number of identical, or different messages, per more than one group for the normal, alarm transmissions. In addition the length and periodicity of the transmissions can also be different and still conform to the methods disclosed here.

We claim:

1. In a communications system comprising a plurality of remote transmitting devices and a receiving station having a receiver associated therewith, each of said remote transmitting devices capable of transmitting a supervision signal having a plurality of correlated supervision messages and a non-supervision signal having a plurality of correlated non-supervision messages, a method for automatically testing the communications system comprising the steps of:

a) receiving at said receiving station a first message from a transmitting device;

b) determining if said first message is a supervision message or a non-supervision message; and c) impairing the ability of the receiving station to properly detect a subsequent message when said first message is determined to be a supervision message.

2. The method of claim 1 further comprising the steps of:

d) receiving a subsequent message;

e) determining if said subsequent message is correlated to said first message; and f) removing the impairment of the ability of the receiving station to properly detect a subsequent message when said subsequent message is determined to be correlated to said first message.

3. The method of claim 2 further comprising the step of subsequently processing said first message as being part of a validly received supervision signal when said subsequent message is determined to be correlated to said first message.

4. The method of claim 2 further comprising, when said subsequent message is not correlated to said first message, the steps of (i) maintaining the impairment of the ability of the receiving station to properly detect a subsequent message, (ii) processing said subsequent message as being part of a validly received signal, and (iii) waiting to receive a further subsequent message.

5. The method of claim 1 further comprising the steps of removing the impairment of the ability of the receiving station to properly detect a subsequent message and ignoring said first message when, after a predetermined time, no subsequent message has been received which is correlated to said first message.

6. The method of claim 1 wherein said transmitting devices and said receiver communicate with electromagnetic wave transmission.

7. The method of claim 6 wherein said electromagnetic wave transmission is radio frequency wave transmission.

8. The method of claim 1 wherein the impairing step comprises the step of reducing the input signal sensitivity of the receiver.

9. The method of claim 2 wherein the impairing step comprises the step of reducing the input signal sensitivity of the receiver, and wherein the impairment removal step comprises the step of returning the input signal sensitivity to normal.

10. The method of claim 2 wherein said subsequent message is determined to be correlated to said first message when they are identical to each other.

11. The method of claim 1 wherein said communications system is an alarm system, at least one of said remote transmitting devices is associated with an alarm sensor, and wherein said non-supervision signal from said transmitting device associated with an alarm sensor is an alarm signal comprising alarm messages encoded with alarm sensor data.

12. In an alarm system comprising a plurality of remote transmitting devices and a receiving station having a receiver associated therewith, said receiver having at least one modifiable operational parameter, each of said remote transmitting devices capable of transmitting a supervision signal having a plurality of correlated supervision messages and an alarm signal having a plurality of correlated alarm messages, a method for automatically testing the alarm system comprising the steps of:

a) receiving at said receiving station a first message from a transmitting device;

b) determining if said first message is a supervision message or an alarm message;

c) modifying an operational parameter of the receiver when said first message is determined to be a supervision message;

d) receiving a subsequent message;

e) determining if said subsequent message is correlated to said first message;

f) when said subsequent message is determined to be correlated to said first message, then performing the steps of returning the modified operational parameter of said receiver to normal, and subsequently processing said first message as being part of a validly received supervision signal;

g) when said subsequent message is determined to be not correlated to said first message, then performing the steps of maintaining the modified operational parameter of said receiver, processing said subsequent message as being part of a validly received signal, and waiting to receive a further subsequent message; and (h) returning the modified operational parameter of said receiver to normal and ignoring said first message when, after a predetermined time, no subsequent message has been received which is correlated to said first message.

13. The method of claim 12 wherein the receiver operational parameter modification step comprises the step of reducing the input signal sensitivity of the receiver.

14. The method of claim 13 wherein the receiver operational parameter normalization step comprises the step of returning the receiver input signal sensitivity to normal.

15. The method of claim 14 wherein said subsequent message is determined to be correlated to said first message when they are identical to each other.

16. The method of claim 15 wherein said transmitting devices and said receiver communicate with electromagnetic wave transmission.

17. The method of claim 16 wherein said electromagnetic wave transmission is radio frequency wave transmission.

18. A data communications system comprising:

(a) a plurality of remote devices, each of said remote devices comprising means for transmitting supervision signals and non-supervision signals; and (b) a receiving station comprising:

(i) means for receiving said supervision signals and said non-supervision signals, and (ii) processing means for impairing the ability of the receiving station to properly detect a subsequent message in response to the receipt of a supervision signal.

19. The communications system of claim 18 wherein each of said supervision signals comprise first and second messages correlated to each other, and wherein said processing means impairs the ability of the receiving station to properly detect a subsequent message in response to the receipt of a first message from a supervision signal, and wherein said processing means removes the impairment of the ability of the receiving station to properly detect a subsequent message if a subsequent message correlated to said first message is received while the ability of the receiving station to properly detect a subsequent message is impaired.

20. The communications system of claim 19 wherein said supervision signal is further processed by said receiving station as a successfully received supervision signal if a subsequent message correlated with said first message is received while the ability of the receiving station to properly detect a subsequent message is impaired.

21. The communications system of claim 20 wherein said processing means removes the impairment of the ability of the receiving station to properly detect a subsequent message after a predetermined time has elapsed if a subsequent message correlated with the first message is not received while the ability of the receiving station to properly detect a subsequent message is impaired.

22. The communications system of claim 21 wherein said supervision signal is not further processed by said receiving station as a successfully received supervision signal if a subsequent message correlated with the first message is not received while the ability of the receiving station to properly detect a subsequent message is impaired after a predetermined time has elapsed.

23. The communications system of claim 22 wherein, when a subsequent message not correlated with the first message is received while the ability of the receiving station to properly detect a subsequent message is impaired, said subsequent message is further processed by said receiving station as a successfully received message and the impaired ability of the receiving station to properly detect a subsequent message is maintained.

24. The communications system of claim 23 wherein the ability of the receiving station to properly detect a subsequent message is impaired by reducing the input signal sensitivity of the receiver means.

25. The communications system of claim 24 wherein the input signal sensitivity of the receiver is returned to normal by being increased to normal operating level.

26. The communications system of claim 25 wherein said subsequent message is determined to be correlated to said first message when they are identical to each other.

27. The communications system of claim 26 wherein said remote devices and said receiving means communicate by electromagnetic wave transmission.

28. The communications system of claim 27 wherein said electromagnetic wave transmission is radio frequency wave transmission.

29. The communications system of claim 28 wherein at least one of said remote devices is associated with an alarm sensor.

30. An alarm system comprising:

(a) a plurality of remote devices, each of said remote devices having a transmitter for transmitting a supervision signal comprising a plurality of correlated supervision messages and an alarm signal comprising a plurality of correlated alarm messages indicative of an alarm status;

(b) a receiving station comprising:

(i) a receiver for communications with each of said remote devices, and (ii) processing means operatively associated with said receiver for processing messages received from each of said remote devices, said processing means being configured to decode a first message received from a remote device and execute a supervision routine if said first message is determined to be a supervision message;

wherein said supervision routine causes the impairment of the ability of the receiving station to properly detect a subsequent message.

31. The alarm system of claim 30 wherein said supervision routine further causes the removal of the impairment of the ability of the receiving station to properly detect a subsequent message and further processes said first message when a subsequent message received from a remote device is correlated with said first message.

32. The alarm system of claim 31 wherein, when said subsequent message is not correlated with said first message, said supervision routine further causes said receiving station to maintain its impairment of its ability to properly detect a subsequent message, to further process said subsequent message as a successfully received message, and to wait for additional subsequent messages.

33. The alarm system of claim 32 wherein said supervision routine further causes the removal of the impairment of the ability of the receiving station to properly detect a subsequent message and the ignoring of said first message when, after the lapse of a predetermined time that the receiving station has had its ability to properly detect a subsequent message in a impaired state, no subsequent message has been received which is correlated with said first message.

34. The alarm system of claim 33 wherein the ability of the receiving station to properly detect a subsequent message is impaired by reducing the input signal sensitivity of the receiver.

35. The alarm system of claim 34 wherein the input signal sensitivity of the receiver is returned to normal by being increased to normal operating level.

36. The alarm system of claim 35 wherein said subsequent message is determined to be correlated to said first message when they are identical to each other.

37. The alarm system of claim 36 wherein said remote devices and said receiving means communicate by electromagnetic wave transmission.

38. The alarm system of claim 37 wherein said electromagnetic wave transmission is radio frequency wave transmission.

39. A receiving station for use in a data communications system comprising a plurality of remote devices, each of said remote devices having a transmitter for transmitting a supervision signal comprising a plurality of correlated supervision messages and a non-supervision signal, said receiving station comprising:

(a) a receiver for communications with each of the remote devices, and (b) processing means operatively associated with said receiver for processing messages received from each of the remote devices, said processing means being configured to decode a first message received from a remote device and execute a supervision routine if said first message is determined to be a supervision message;

wherein said supervision routine causes the impairment of the ability of the receiving station to properly detect a subsequent message.

40. The receiving station of claim 39 wherein said supervision routine further causes the removal of the impairment of the ability of the receiving station to properly detect a subsequent message and the further processing of said first message when a subsequent message received from a remote device is determined to be correlated with the first message.

41. The receiving station of claim 39 wherein, when a subsequent message is not received which is correlated with said first message, said supervision routine further causes the impaired ability of the receiving station to properly detect a subsequent message to remain so impaired, to further process said subsequent message as a successfully received message, and to wait for additional subsequent messages.

42. The receiving station of claim 39 wherein said supervision routine further causes the removal of the impairment of the ability of the receiving station to properly detect a subsequent message and the ignoring of said first message when, within a predetermined time that the operational parameter of said receiver has been so impaired, no subsequent message has been received which is correlated with said first message.

43. The receiving station of claim 40 wherein the ability of the receiving station to properly detect a subsequent message is impaired by reducing the input signal sensitivity of the receiver.

44. The receiving station of claim 43 wherein the input signal sensitivity of the receiver is returned to normal by being increased to normal operating level.

45. The receiving station of claim 44 wherein said subsequent message is determined to be correlated to said first message when they are identical to each other.

46. The receiving station of claim 45 wherein said receiver receives said supervision signal by electromagnetic wave transmission.

47. The receiving station of claim 46 wherein said electromagnetic wave transmission is radio frequency wave transmission.

48. The receiving station of claim 47 which is suitable for use in an alarm system, and wherein said non-supervision signals are alarm signals comprising alarm messages encoded with alarm status data.

* * * * *